US005345631A

United States Patent [19]

Saperstein et al.

[11] Patent Number: 5,345,631

[45] Date of Patent: Sep. 13, 1994

[54] BED ELEVATOR BLOCK

[75] Inventors: Paul Saperstein; Thomas C. Laughon, Sr., both of Greensboro, N.C.

[73] Assignee: Craft-Tex/Phase IV, Inc., High Point, N.C.

[21] Appl. No.: 58,161

[22] Filed: May 5, 1993

[51] Int. Cl.[5] ..... A47C 21/00; A47C 31/00

[52] U.S. Cl. ..... 5/509.1; 248/188.2; 5/925

[58] Field of Search ..... 5/509.1, 658, 11, 925; 248/188.2, 649

[56] References Cited

U.S. PATENT DOCUMENTS

| | | | |
|---|---|---|---|
| 575,806 | 1/1897 | Garvey | 248/188.2 |
| 1,655,611 | 1/1928 | Jensen | 248/188.2 |
| 2,366,867 | 1/1945 | Nichthauser | 248/188.2 |
| 2,830,303 | 4/1958 | Sandock | 5/509.1 |
| 2,893,164 | 7/1959 | Martin | 5/509.1 |
| 2,933,850 | 4/1960 | Martin | 5/509.1 |
| 2,941,329 | 6/1960 | Apparius | 248/188.2 |
| 2,958,373 | 11/1960 | Behrens | 5/924 |
| 3,247,528 | 4/1966 | Swenson et al. | 5/509.1 |
| 3,310,289 | 3/1967 | Burke | 5/509.1 |
| 4,117,999 | 10/1978 | Gessler | 248/188.2 |
| 4,312,088 | 1/1982 | Webb | 5/509.1 |
| 4,830,320 | 5/1989 | Bellows | 248/188.2 |

OTHER PUBLICATIONS

Photographs (3) of Metal Cone Device with Concave Top Surface, Purchased from McLarty Surgical Supply, High Point, North Carolina on Apr. 22, 1993.

*Primary Examiner*—Alexander Grosz

*Attorney, Agent, or Firm*—Rhodes, Coats & Bennett

[57] ABSTRACT

An apparatus for raising one end of a bed which comprises the placement of elevator blocks under the support legs of one end of a conventional bed. The elevator block comprises top and bottom ends that are non-parallel planar surfaces. The planar surface of the top end is inclined to allow for proper mating of the top end of the elevator block with a bed leg in the bed's raised position. Provision is also made for a removable insert in a cavity of the top end of the elevator block, so that bed legs can sit either within the cavity for increased stability or upon the top of the insert, depending upon the size of the bed leg. The use of slip-resistant materials on the surfaces contacting either the floor or bed leg also add to the stability of the bed in the raised position.

12 Claims, 2 Drawing Sheets

BED ELEVATOR BLOCK

FIELD OF THE INVENTION

The present invention relates generally to bed supports and, more particularly, to an economical and uncomplicated apparatus that can be used for raising one end of a bed for therapeutic or other purposes.

BACKGROUND OF THE INVENTION

A hiatal hernia is an affliction where an anatomical part (such as a portion of the stomach) protrudes through the esophageal hiatus of the diaphragm. Persons suffering with a hiatal hernia and other ailments frequently are advised to lay on an inclined plane with their head elevated while resting or sleeping as part of the patient's medical treatment or recuperation. Keeping a patient's upper extremities elevated assist in reducing symptoms or complications associated with hiatal hernias, as well as with other gastronomical and respiratory ailments.

Methods and devices used to raise one end of a bed are well known. Examples of known devices are found in U.S. Pat. Nos. 2,830,303; 3,247,528; 3,310,289; and 4,312,088. Similarly, furniture leg extenders are disclosed in U.S. Pat. No. 4,117,999.

However, previous attempts to design an apparatus for raising a bed have involved complicated structures requiring either separate bed construction, extensive modification of a conventional bed, or manufacture of an apparatus of multiple parts and elements. Moreover, no previous designs have adequately provided a low cost, portable design that properly considers the angle created when a bed is in its raised, as opposed to its horizontal, position. The purpose of this invention, therefore, is to provide an economical and uncomplicated system for raising one end of a bed for therapeutic or other purposes.

SUMMARY OF THE INVENTION

The present invention is directed to an improved apparatus for raising a bed where elevator blocks are placed under the support legs of one end of a conventional bed. The elevator block comprises a top end and a bottom end. A front edge and a rear edge are located on the top end. During use, the bottom end of the elevator block rests on a horizontal bed supporting surface, such as a floor or platform. The top end supports a corresponding leg of the bed. The rear edge of the top end is proximately located nearest the upper-most portion of the raised end of the bed. The top and bottom ends have substantially planar surfaces. The planar surface of the top end is inclined so that the distance from the bottom end to the front edge is less than the distance from the bottom end to the rear edge. Provision is also made for a removable insert in a cavity of the top end of the angular block, so that bed legs can sit within a cavity for increased stability. The use of non-skid materials on the surfaces contacting either the floor and/or bed leg also add to the stability of the bed in the raised position.

Accordingly, one aspect of the present invention is to provide a low cost and uncomplicated design of a elevator block that can be used to raise one end of a conventional bed with little to no need to modify the existing bed support means.

Another aspect of the present invention is to provide an elevator block for beds that takes into consideration the angle of the bed when the bed is in the elevated or raised position.

Still another aspect of the present invention is to provide an elevator block that can be easily adapted to receive various types of bed support means and hold the bed in a stable position when elevated.

These and other aspects of the present invention will become apparent to those skilled in the art after a reading of the following description of the preferred embodiments when considered with the drawings.

DESCRIPTION OF THE PREFERRED EMBODIMENTS

The drawings are for the purpose of describing a preferred embodiment of the invention and are not intended to limit the present invention. References below to angles of various inclined surfaces refer to the angle measured from horizontal.

Figure 1:
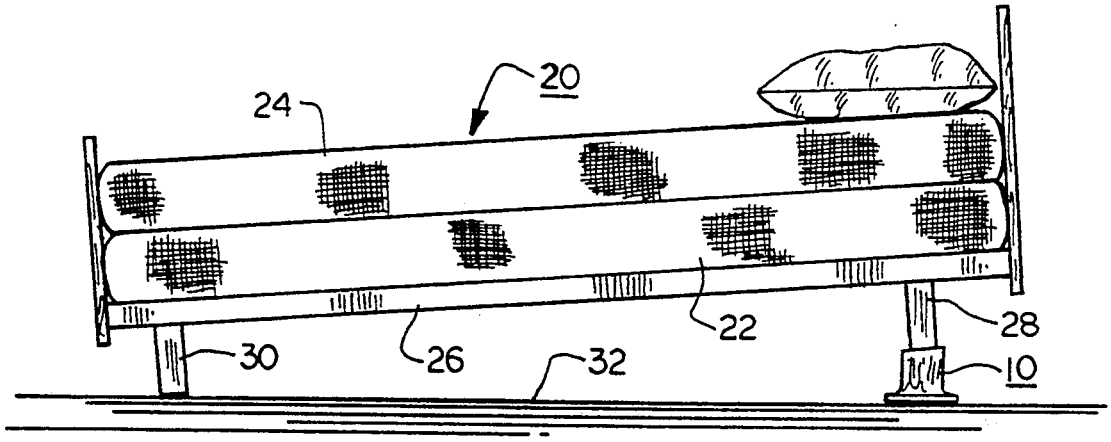
FIG. 1 is an environmental view of an elevator block used in conjunction with a conventional bed.

In FIG. 1, an elevator block is indicated generally by the numeral 10. A conventional bed 20 is indicated generally, with its parts including box springs 22, mattress 24, frame 26, front legs 28 and rear legs 30. The front legs 28 and rear legs 30 rest on a bed supporting means 32, such as a floor or platform. FIG. 1 illustrates the use of two elevator blocks with a bed with two front legs in the bed's raised position.

Figure 2:
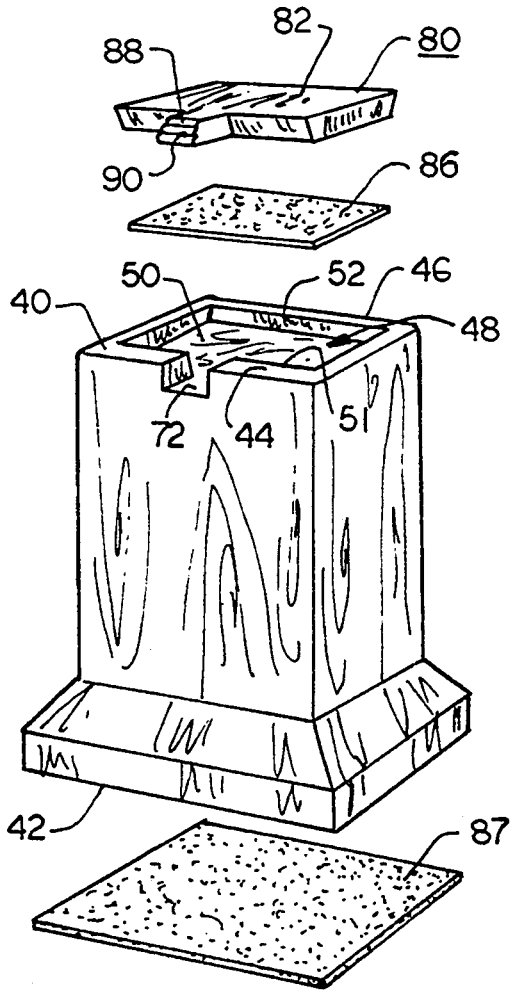
FIG. 2 is a perspective, exploded view of the elevator block.

FIG. 2 depicts a perspective view of an elevator block 10, with a top end 40 and bottom end 42. Both the top end 40 and bottom end 42 have substantially planar surfaces. The top end 40 having a front edge 44 and rear edge 46, located at opposite edges of the top end. The rear edge 46 is defined to be the edge closest to the uppermost portion of the raised end of the bed 20, which typically will be the head position of the bed during normal use in which the occupant's upper extremities are elevated. The planar surface of the top end 40 is non-parallel to the planar surface of the bottom end 42, and is inclined in the same direction as the incline of the bed in its raised position as shown in FIG. 1.

For stability, and as shown in FIG. 2, the surface area of the bottom end 42 preferably should be larger than the surface area of the top end 40. Stability is also achieved by constructing the elevator block out of a solid material, such as hard plastic, so that the block's weight is great enough to resist sliding as it rests upon the bed support surface during use.

Further as shown in FIG. 2, within the top end 40, there resides a cavity generally shown as numeral 48, with a cavity base 50 and front side wall 51 and rear side walls 52. The size of the cavity 48 is sufficient to allow the insertion during use of a front bed leg 28, where the bottom of the front bed leg 28 rest upon the cavity base 50. Further, the cavity base 50 is a substantially planar surface and nonparallel to the planar surface of the bottom end 42 of the elevator block.

An embodiment whereby the front edge 44 has an opening 72 is also shown in FIG. 2. One of the purposes of the opening is to allow the user to correctly orient the elevation block during use.

An insert 80 is sized so that it may be removably mated within the cavity 48. A protrusion 88, containing friction grooves 90, extends from the insert. The protrusion 88 is sized and placed to fit within the opening 72 of the cavity 48. The friction grooves 90 allow the insert to be easily grasped and removed from the cavity 48.

Slip-resistant surfaces 86 and 87, such as an adhesive-backed thin cork material, can be mounted for stability purposes on the surfaces that contact both the bed support surface 32 or the bed leg 28. More particularly, slip-resistant surface 86 may be mounted either upon the cavity base 50 when the bed leg 28 rest directly upon the cavity base 50, or upon a top surface 82 of the insert 80 when the bed leg 28 rests upon the top surface 82. Similarly, slip-resistant surface 87 may be mounted directly to the bottom end 42.

Figure 3:
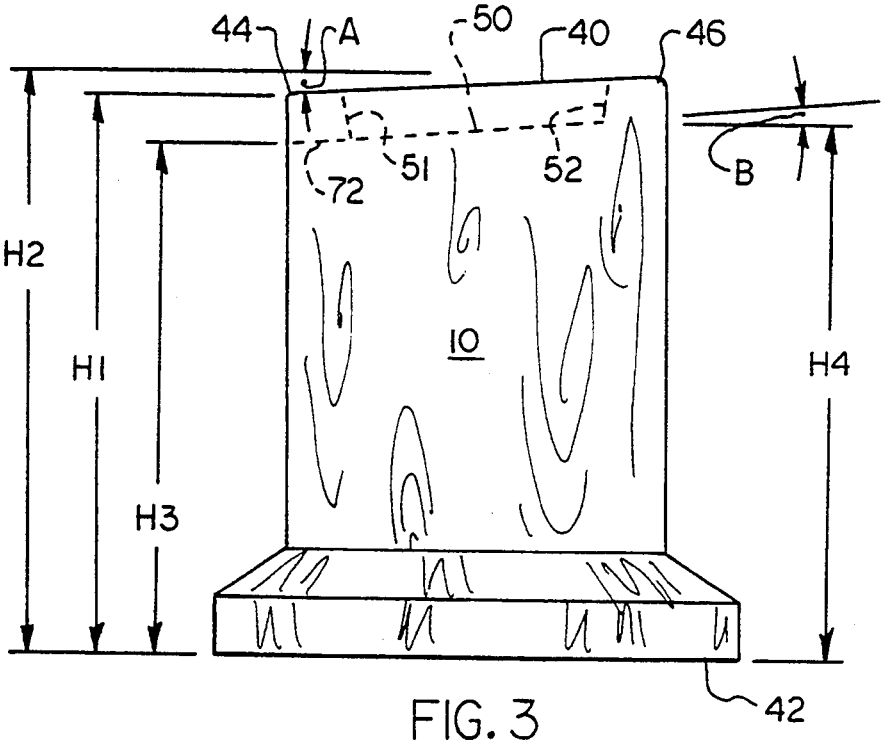
FIG. 3 is a side elevation view of the elevator block.

FIG. 3 depicts a side view of an elevator block 10. The planar surface of the top end 40 is inclined at an angle A. In preferred use, angle A will be about 3 ½ degrees, but may range from between about 1 to 8 degrees to account for different lengths of beds and desired elevation angles. Also shown in FIG. 3 is the height H1 of the front edge 44 from of the bottom end 42 and the height H2 of the rear edge 46 from the bottom end 42. In preferred use, height H1 will be about 6¼ inches and height H2 will be about 6 7/16 inches. However, both heights Hi and H2 may range from between about 4 to 9 inches, again to account for different lengths of beds and desired elevations. The incline angle A for a desired elevation and given bed length may be determined by either trial and error or trigonometric calculations.

As also shown in FIG. 3, the cavity base 50 is inclined in the same direction as the incline of the bed in its raised position as shown in FIG. 1 and is inclined at an angle B. In preferred use angle B is 4 degrees, but may range from between about 1 to 8 degrees. In preferred use the height from the bottom end to the cavity base 50 will range linearly from a height H3 of about 5⅞ inches to a height H4 of about 6 1/32 inches along the inclined plane of the cavity base 50. However, either height H3 or H4 may range from between 4 to 9 inches to account for different lengths of beds and desired elevation angles. Either trial and error or trigonometric calculations can determine the incline angle B and heights H3 and H4 for a desired elevation and bed length.

Figure 4:
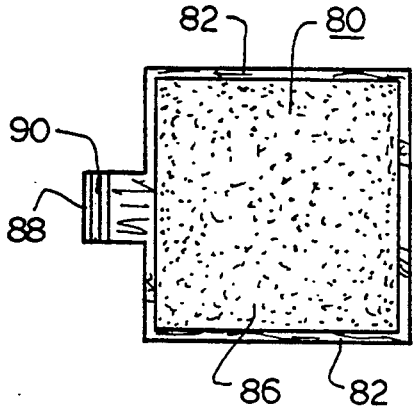
FIG. 4 is a top view of an insert for a cavity for use with the elevator block.

FIG. 4 is a top view of the insert 80, which further has an upper surface 82. The slip-resistant surface 86 is shown mounted on the upper surface 82 in this embodiment.

Figure 5:
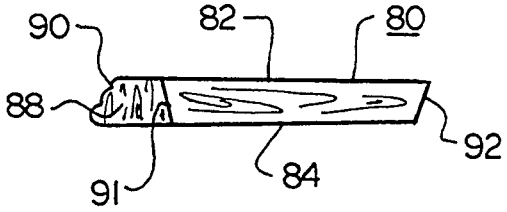
FIG. 5 is a side view of the insert for a cavity for use with the elevator block.

FIG. 5 depicts a front side wall 91 and a rear side wall 92 of the insert 80. The side walls 92 are tapered, which assist in placing and removing the insert 80 from the cavity 72, as well as helps distribute the load on the insert caused by the force of the bed and bed leg 28 during use. During use, the front side wall 91 and rear side wall 92 of the insert 80 may contact respectively the front side wall 51 and rear side wall 52 of the cavity 48. FIG. 5 also shows the non-parallel relationship between the upper surface 82 and a lower surface 84, required so that the insert may be removably mated within the cavity 48. In other words, in a preferred embodiment where angle A will be slightly greater than angle B, the surface 82 also should be inclined at an angle A while the surface 84 should be inclined at an angle B to insure proper mating when the insert is placed within the cavity.

An elevator block that contains a cavity 48 and insert 80 as described above is the preferred embodiment since it will be versatile and capable of fitting many types of conventional bed frame legs.

The above description of the preferred embodiments thus detail many ways in which the present invention can be used to raise one end of a bed. While several preferred embodiments are described in detail hereinabove, it is apparent that various changes might be made without departing from the scope of the invention, which is set forth in the accompanying claims.

I claim:

1. An elevator block, for use in raising one end of a conventional bed supported by a plurality of legs resting on a horizontal bed supporting surface, comprising:

(a) a top end adapted to support a corresponding leg of the bed and having a substantially planar surface;

(b) a bottom end adapted to rest on said bed support surface and having a substantially planar surface;

(c) said top end having a front edge and a rear edge, with the rear edge defined to be proximately located nearest the uppermost portion of the raised end of said conventional bed; said planar surface of the top end being non-parallel to the planar surface of bottom end; said planar surface of the top end being an inclined plane such that the height from the bottom end to the front edge is less than the height from the bottom end to the rear edge and wherein the top end further comprises:

(d) a cavity comprising a base;

(e) an opening in said front edge;

(f) an insert which is sized so that it may be removably mated within said cavity;

(g) said insert having a protrusion which fits within said opening of said front edge to allow the insert to be grasped and removed from the cavity.

2. The elevator block according to claim 1, wherein said bottom end has a surface area greater than the surface area of said top end.

3. The elevator block according to claim 1, wherein the planar surface of the top end is inclined from horizontal between about 1 and 8 degrees.

4. The elevator block according to claim 1, wherein the distance from the bottom end to the front edge is between about 4 and 9 inches.

5. The elevator block according to claim 1 wherein the elevator block is used in conjunction with other elevator blocks of the same plurality as the number of legs supporting one end of said bed to form a bed raising system.

6. The elevator block according to claim 1 wherein the planar surface of the top end is parallel to the planar surface defined by the bottom of all of the bed support legs when said elevator blocks are used and one end of the bed is in its raised position.

7. The elevator block according to claim 1 wherein the planar surface of the bottom end has a slip-resistant surface to help keep the elevator block from slipping during use.

8. The elevator block according to claim 1 wherein the top end further includes:

(a) a cavity comprising a base, upon which said bed leg sits during use;

(b) said cavity being of sufficient size to allow during use for the insertion of said bed leg; and (c) said base being a substantially planar surface and nonparallel to the planar surface of the bottom end of the elevator block (d) said base further being substantially parallel to the plane of the bed when the bed is in its raised position.

9. The elevator block according to claim 1 wherein said protrusion further includes grooves to allow the insert to be easily grasped and removed from the cavity.

10. The elevator block according to claim 1, wherein said insert further includes front and rear side walls that are tapered.

11. The elevator block according to claim 1, wherein said insert further includes an upper surface which comprises a slip-resistance surface adapted to help keep the bed leg from slipping during use.

12. An elevator block for use in raising one end of a conventional bed supported by a plurality of legs resting on a horizontal bed supporting surface, comprising:

(a) a top end adapted to support a corresponding leg of the bed and having a substantially planar surface;

(b) a bottom end adapted to rest on said bed support surface;

(c) said top end having a front edge and a rear edge, with the rear edge defined to be proximately located nearest the uppermost portion of the raised end of said conventional bed; said planar surface of top end being non-parallel to planar surface of bottom end; said planar surface of top end being an inclined place such that the height from the bottom end to the front edge is less than the height from the bottom end to the rear edge;

(d) said top end further including a cavity comprising a base, an opening in said front edge, an insert which is sized so that it may be removably mated within said cavity, said insert having a protrusion which fits within said opening of said front edge to allow the insert to be grasped and removed from the cavity;

(e) said protrusion further including grooves to allow the insert to be easily grasped and removed from the cavity;

(f) said insert further including a front and rear sidewalls that are tapered; and (g) said insert further including an upper surface which comprises a slip-resistance surface adapted to help keep the bed leg from slipping during use.

* * * * *